United States Patent [19]

Liao

[11] Patent Number: 4,856,189

[45] Date of Patent: Aug. 15, 1989

[54] METHOD FOR MANUFACTURING MULTIPLE PUSH-BUTTON AND CONDUCTIVE MEMBERS FOR DIP SWITCHES

[76] Inventor: Pen-Lin Liao, No. 1-11, Li-Ming Rd., Nan Tung Dist., Taichung City, Taiwan

[21] Appl. No.: 207,495

[22] Filed: Jun. 16, 1988

[51] Int. Cl.[4] ..... H01R 43/04

[52] U.S. Cl. ..... 29/882; 29/411; 29/418; 29/876; 29/622

[58] Field of Search ..... 29/881-884, 29/876, 877, 411, 418, 622; 200/293

[56] References Cited

U.S. PATENT DOCUMENTS

| | | | |
|---|---|---|---|
| 3,444,619 | 5/1969 | Lomerson | 29/884 |
| 4,530,552 | 7/1985 | Meehan et al. | 29/876 |
| 4,653,179 | 3/1987 | Neumann-Henneberg et al. | 29/622 |
| 4,780,093 | 10/1988 | Walse et al. | 29/881 |

*Primary Examiner*—P. W. Echols

*Attorney, Agent, or Firm*—Kirschstein, Ottinger, Israel & Schiffmiller

[57] ABSTRACT

A method for manufacturing multiple push-button and conductive members for dual-in-line package (DIP) switches includes the steps of: integrally forming a multiple push-button member and a conductive member in respective molds; superimposingly combining the push-button member and the conductive member together for being pressed as a single solid unit; and cutting each combined solid unit into a plurality of push-button units. Each of the integrally formed push-button members includes an enclosed frame, a plurality of partitioning ribs symmetrically spaced in the enclosed frame, and a predetermined quantity of push-button bodies respectively provided in rows between the partitioning ribs; and each conductive member includes a pair of supporting bands formed in parallel in conjunction with the enclosed frame, and a predetermined quantity of conductive pieces integrally connected in rows between the supporting bands. Thus, after the two members are combined into a single piece, all the push-button bodies can be simultaneously cut into units in an integrated operation without any burs left on them.

1 Claim, 3 Drawing Sheets

METHOD FOR MANUFACTURING MULTIPLE PUSH-BUTTON AND CONDUCTIVE MEMBERS FOR DIP SWITCHES

BACKGROUND OF THE INVENTION

This invention relates to a method for manufacturing multiple push-button and conductive members for dual-in-line package (DIP) switches, and particularly to that method by which the multiple push-button and conductive members are integrally produced and simultaneously processed to provide individual push-button units which are free from any burs so as to assure the precision of DIP switches.

it is known that the DIP switch is an indispensable item in the development of the information industry because all DIP switches are directly installed on PC boards to effect various functional settings usually concerning arithmatic operations with the digits "0" and "1". It is for this reason that the structure of the DIP switches must be of high quality and precision, so as to ensure the exactness of the signal output therefrom. Unfortunately, the known method for producing the push-button and conductive members of the conventional DIP switches cannot satisfy the high precision requirement. As shown in FIG. 1, the structure of the conventional DIP switches is generally composed of a substrate 1, a plurality of leads 2 extending from two opposing sides of the substrate 1, a plurality of push-button members 3 and a cover 4. The substrate 1 is provided with a rectangular open section 1*a* for accommodating the push-button members 3. Each of the push-button members 3 is composed of a push button 3*a* having an upper pushing post 3*a*1 extending upward in the middle and a lower pushing post 3*a*2 protruding downward from the bottom side of the upper push post 3*a*1, and a conductive member 3*b* superimposedly disposed on the bottom side of the push button 3*a* with the lower pushing post 3*a*2 being inserted into an opening 3*b*1 of the conductive member 3*b*. Such a delicately combined article should be produced with high quality for satisfying the high precision requirement. Unfortunately, the known method for manufacturing the push-button member 3 normally consists the following steps: separately molding each push button 3*a* and each conductive member 3*b* in a respective mold; removing the molded push button 3*a* and the conductive member 3*b* from the respective mold with a driving rod; and separately combining each conductive member 3*b* with each push button 3*a* to form a push-button unit 30. The individually combined push-button units 30 are then respectively arranged within the open section 1*a* of the substrate 1 with the cover 4 having a plurality of openings 4*a* formed therein being connected to the substrate 1 with each upper pushing post 3*a*1 protruding out of the respective openings 4*a*. The shortcomings of the combined push-button units 30 produced by the above known method are as follows:

(1) All the push buttons 3*a* are made of a plastic material and are generally produced through injection molding. It is well known that, during injection operation, when the movable mold portion is open, and the molded part is to be ejected from the mold cavity, a push rod is usually used to drive the molded part out of the mold cavity. Owing to the fact that during the ejection period, the push rod and the mold are both being maintained at a high temperature, and that since a slit usually exists in the stationary mold portion for permitting the push rod to move therein so as to thrust the molded part out of the cavity of the stationary mold, a plurality of driving marks thus made by the push rod are always left on the molded part. These marks are normally called "burred ridge" or "burs", and these "burs" will increase with every operation of the mold. As a structure of a DIP switch is usually very small, the burs left on the smaller push-button members 3 will certainly affect the precision of their performance.

(2) The manufacturing operations and combination of all the push buttons 3*a* and the conductive members 3*b* are usually manually carried out one item at a time. This kind of working is rather time-consuming and wastes too much manpower.

SUMMARY OF THE INVENTION

It is accordingly a primary object of this invention to provide a method for integrally manufacturing multiple push-button and conductive members for dual-in-package (DIP) switches, by which the combined push-button units can be quickly produced without any burs left thereon so that the precision of the operation of the DIP switches can be ensured.

It is another object of this invention to provide a method for integrally manufacturing multiple push-button and conductive members for DIP switches, by which the manufacturing process is simplified to save manpower and increase productivity.

These and other objects of the present invention will become apparent from the following detailed description of a preferred embodiment of a method for manufacturing multiple push-button and conductive members for DIP switches, each of which, as usual, includes a substrate with a rectangular open section formed for accommodating a plurality of push-button units therein, and a covering member coupled with the substrate in conjunction with the push-button units. The method according to this invention comprises the steps of: integrally forming a multiple push-button member with plastic material, and a multiple conductive member with metal material, respectively in a push-button member mold and a conductive member mold; separately combining the integrally formed multiple push-button members and the multiple conductive members in conjunction with the corresponding parts of both members for being pressed together as a single solid unit; and cutting each combined unit of the combined multiple push-button member and the multiple conductive member into individual push-button units; so that integrated operations can be quickly performed for producing the push-button units for DIP switches without encurring any burs on the bodies of the push-button members. Each of the push-button members thus produced includes: an enclosed frame divided into an upper portion and a lower portion; a plurality of partitioning ribs symmetrically located in the upper and lower portions; and a plurality of push-button bodies integrally formed in rows between each pair of ribs in the upper and lower portions of the enclosed frame; and each of the conductive members thus produced includes a plurality of conductive pieces integrally formed in line with the push-button bodies in the upper and lower portions of the enclosed frame to be combined with the push-button member through a pressing operation so as to be delivered to a cutting-off machine and cut into individual push-button bodies so that they can be respectively disposed in the open section of the substrate and coupled with the covering member. Consequently, all the push-button members and the conductive members are integrally formed and can be simultaneously cut into push-button units without causing any burs. Therefore, not only are the high quality and precision performance of the DIP switches ensured, but also economical manufacturing operations and mass production are achieved.

Other advantages and characteristics of this invention will become apparent from the following detailed description of a preferred embodiment of an integrally combined multiple push-button device for DIP switches when read in conjunction with the accompanying drawings.

DETAILED DESCRIPTION OF THE PREFERRED EMBODIMENT

Figure 1:
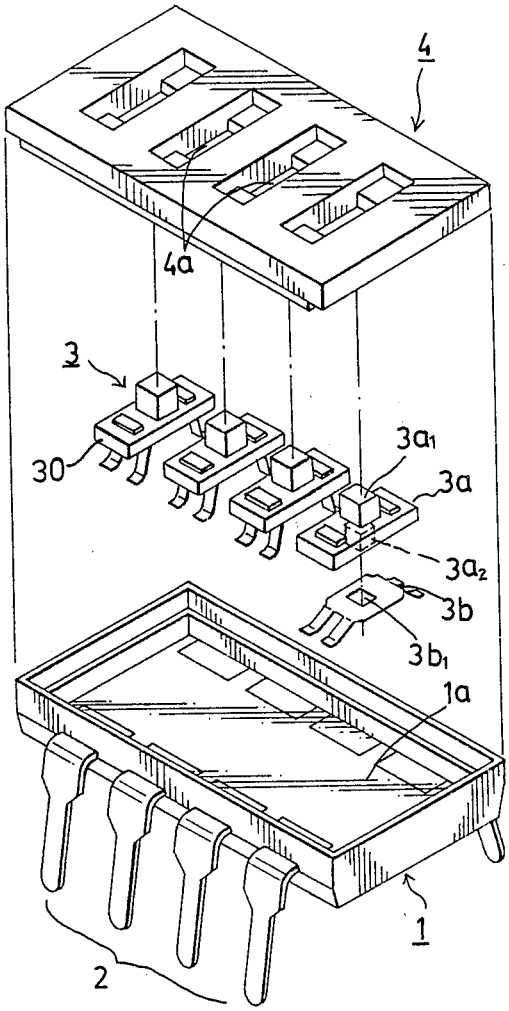
PRIOR ART FIG. 1
FIG. 1 is an exploded and perspective view of a plurality of push-button units made by a conventional method for DIP switches.
Figure 2:
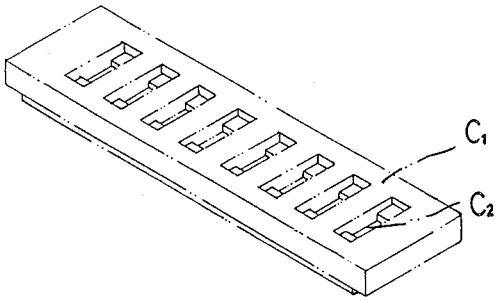
FIG. 2 is an exploded and perspective view of a preferred embodiment of an integrally formed multiple push-button member and a conductive member for being combined to produce individual push-button units for DIP switches according to this invention.
Figure 2:
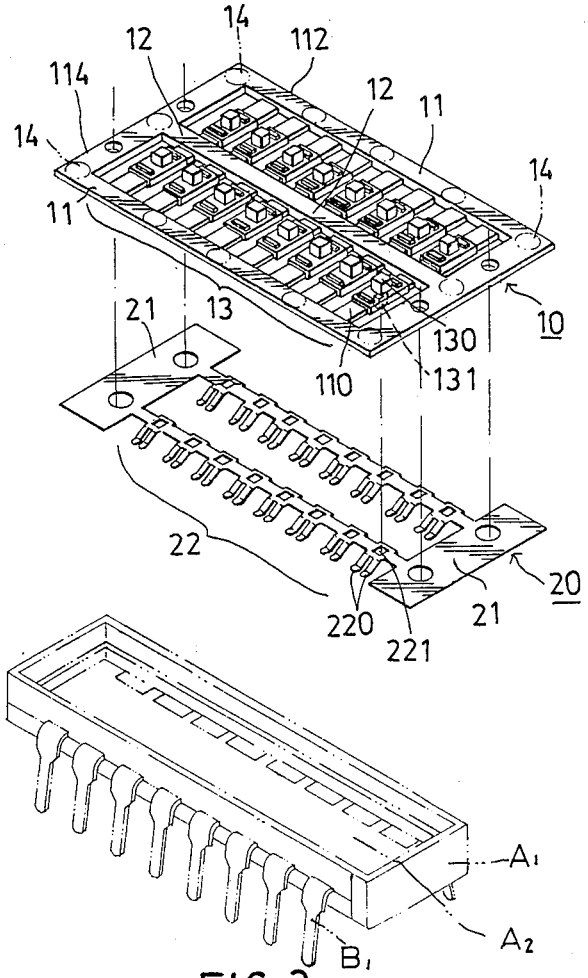
Figure 3:
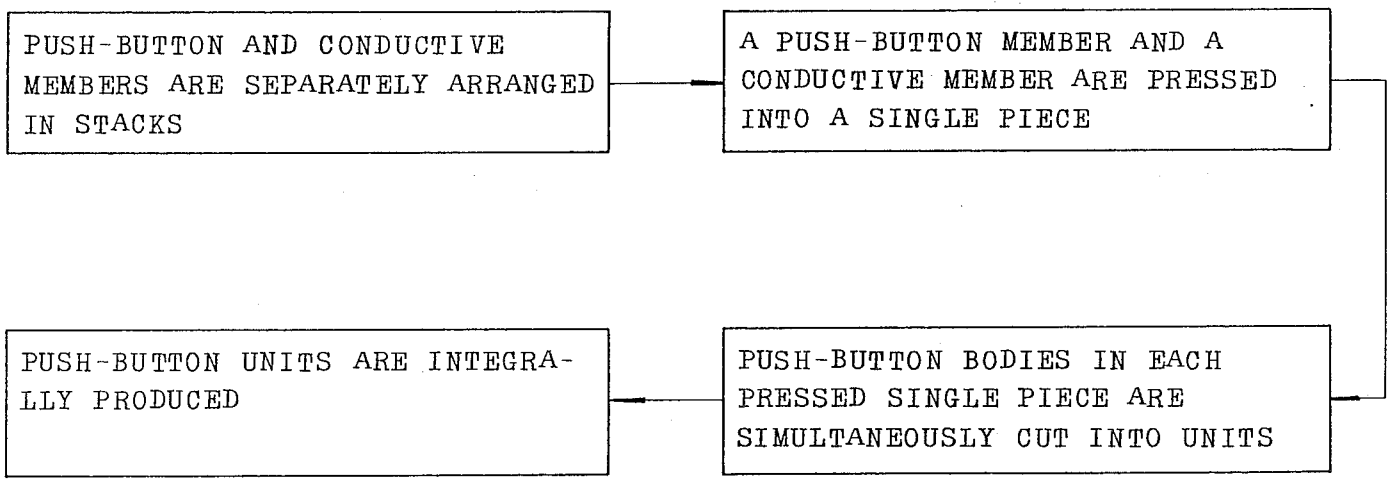
FIG. 3 is a block diagram showing an automated production procedure for preparing the push-button units according to this invention.

Referring to FIGS. 2 and 3, the preferred embodiment of a method for manufacturing multiple push-button members and conductive members for DIP switches, each of which includes a substrate A1 with a rectangular open section A2, a plurality of leads B1 disposed on two opposite sides of the substrate A1, and a covering member C1 with a plurality of openings C2 formed therein. The preferred method according to this invention comprises the steps of: integrally forming a multiple push-button member 10 with plastic material and a conductive member 20 with metal material respectively in a push-button member mold and a conductive-member mold (not shown); separately combining a push-button member 10 and a conductive member 20 with the corresponding parts of both members being aligned thereat for being pressed by a pressing mechanism (not shown) into a single solidified unit; and cutting each combined unit of the multiple push-button and conductive members into a plurality of individual push-button units through a cutting mechanism (not shown).

Each of the integrally formed push-button members 10 includes an enclosed frame 11 evenly divided into an upper portion 112 and a lower portion 114 through a central spine 12 with a plurality of partitioning ribs 110 symmetrically spaced therein, and a predetermined quantity of push-button bodies 13 arrayed in rows between each pair of partitioning ribs 110 in the upper and lower portions 112 and 114, and each of the push-button bodies 13 being formed with an upper pushing piece 130 extending upward thereat and a lower pushing piece 131 protruding downward on a bottom side of the upper pushing piece 130. The important feature of the integrally formed push-button members 10 is that during the mold removing operations, the driving rod (not shown) used to thrust the molded part out of the mold cavity is only positioned on the enclosed frame 11 and the central spine 12 as illustrated by the burs 14 shown on both of them. Therefore, the push-button bodies 13 are cut off from the enclosed frame 11, and no burs like those caused by the driving rod are ever made on the push-button bodies 13 so that perfect push-button bodies can be mass produced for meeting the requirement of precision DIP switches.

The conductive member 20 integrally produced according to the method of this invention includes a pair of supporting bands 21 parallelly formed in conjunction with the opposing sides of the enclosed frame 11 of the push-button member 10, and two rows of conductive pieces 22 integrally connected between the two supporting bands 21 with the conductive pieces 22 corresponding to the predetermined quantity of the two rows of push-button bodies 13 formed in the enclosed frame 11. Each one of the conductive pieces 22 includes paired contacting pins 220 extending from one side and a retaining opening 221 formed at a top end. It is to be noted that the manufacturing of both the multiple push-button member 10 and the multiple conductive member 20 must be matched with each other so as to be combined together in perfect agreement. In other words, when the multiple push-button member 10 is combined with the multiple conductive member 20 (as is done with a pressing machine), each lower pushing piece 131 will be fittingly engaged in the retaining opening 221 of each conductive piece 22. After each multiple push-button member 10 and each multiple conductive member 20 are consolidated into a single unit, it is delivered to a machine press for being cut into a plurality of individual push-button units.

Shown in FIG. 3 is an automated production process for preparing the combined push-button units for assembling DIP switches according to the method of this invention. The process includes the steps of: separately arranging the integrally formed multiple push-button members 10 and the conductive member 20 in stacks; respectively taking out one piece from each stack for being superimposed and delivered to a pressing mechanism (not shown) through a belt conveyor (not shown) for being pressed together as a single unit; and delivering the consolidated single unit made up of multiple push-button member 10 and conductive member 20 through the belt conveyor to a cutting mechanism (not shown) for cutting all the consolidated single unit into individual push-button units respectively combined with the push-button bodies 13 and the conductive pieces 22. The above-mentioned process can be quickly done, and the salient features are as follows:

(1) The production of the multiple push-button member 10 and the multiple conductive member 20 and the combination and cutting operation of both members 10 and 20 can be quickly accomplished through an integrated operation so that manpower is greatly saved while productivity is effectively promoted.

(2) Since the finished product of the push-button units to be disposed in the DIP switches is completely free from burs, high quality and precision of the DIP switches can be assured.

Having thus described the invention, it is to be understood that many embodiments thereof will suggest themselves without departing from the spirit and scope of the invention. Therefore, it is intended that the specification and drawings be interpreted as illustrative rather than in a limiting sense except as defined in the appended claims.

What is claimed is:

1. A method for manufacturing multiple push-button and conductive members for dual-in-line package (DIP) switches comprising the steps of:

a. integrally forming a multiple push-button member from plastic material in a push-button mold and a multiple conductive member from metal material in a conductive mold;

b. superimposingly combining one of said multiple push-button member with one of said multiple conductive member by aligning each corresponding part of both members for being pressed as a single solid unit; and c. simultaneously cutting said single solid unit into a plurality of push-button units with a cutting mechanism; thereby, said push-button units can be quickly produced for mass production through an integrated operation without encurring any burs on said push-button units.

* * * * *